United States Patent [19]

Koide et al.

[11] Patent Number: 4,528,781

[45] Date of Patent: Jul. 16, 1985

[54] METHOD OF FORMING CAM BY GRINDING

[75] Inventors: Tsuyoshi Koide, Toyota; Norihiko Shimizu, Nagoya; Yuichiro Komatsu; Toshio Maruyama, both of Kariya, all of Japan

[73] Assignee: Toyoda Koki Kabushiki Kaisha, Kariya, Japan

[21] Appl. No.: 487,828

[22] Filed: Apr. 22, 1983

[30] Foreign Application Priority Data

Apr. 29, 1982 [JP] Japan ..... 57-71727

[51] Int. Cl.[3] ..... B24B 1/00

[52] U.S. Cl. ..... 51/281 C

[58] Field of Search ..... 51/281 C, 101 R, 165.77, 51/165.79, 165.89, 105 EC, 326

[56] References Cited

U.S. PATENT DOCUMENTS 4,019,288 4/1977 Moritomo ..... 51/327

4,118,900 10/1978 Moritomo et al. ..... 51/327

4,299,061 11/1981 Parnum et al. ..... 51/101 R

*Primary Examiner*—Frederick R. Schmidt

*Assistant Examiner*—Robert A. Rose

*Attorney, Agent, or Firm*—Oblon, Fisher, Spivak, McClelland & Maier

[57] ABSTRACT

A method of grinding a workpiece for shaping it into a cam by imparting a rotary motion and a rocking motion, which conforms to the profile of a master cam, to the workpiece. In the first rough grinding step, a grinding wheel is rapidly entered into the workpiece while the workpiece is rotated at a low velocity. In the second rough grinding step, the grinding wheel is rapidly entered into the workpiece while the workpiece is rotated at a velocity greater than the low velocity. In the third rough grinding step, the wheel is rapidly entered into the workpiece while the workpiece is rotated at a high velocity. Each of the three steps includes a step for removing the portion left uncut in such a state that the infeed of the wheel is ceased. The depths of cut in the three steps $DS_1$, $DS_2$ and $DS_3$, respectively, are so set that the following relation holds:

$$DS_1 > DS_2 > DS_3$$

10 Claims, 11 Drawing Figures

1ST PRIOR ART

1ST PRIOR ART

2ND PRIOR ART

2ND PRIOR ART

METHOD OF FORMING CAM BY GRINDING

FIELD OF THE INVENTION

The present invention relates to a method of shaping a workpiece into a cam having a desired profile by grinding. More particularly, it relates to a method in which a rotary motion and a rocking motion that conforms to the profile of a master cam are imparted to a workpiece and a grinding wheel is pressed against the workpiece to grind it.

BACKGROUND OF THE INVENTION

Recently, energy savings, decrease in the manufacturing cost and improvement in quality of products have been required increasingly. Also in the field of grinding of cam profiles, automobile manufacturers have played a most active part in requesting shortening of cycle time and improvement in machining accuracy. However, the two requirements are incompatible with each other. Therefore, in spite of various attempts at satisfying both requirements, no satisfactory result has been obtained yet.

In cam profile grinding, a rotary motion and a rocking motion conforming to the profile of a master cam are imparted to a workpiece, and the rate at which the workpiece is removed by grinding, that is, angular displacement $d\theta$ per unit time varies constantly, as shown in FIG. 1. This quantity of change becomes larger if the workpiece is rotated at higher velocity for a constant time of grinding, that is, a constant removed quantity per unit time. At the same time, it is more likely that vibration occurs, but less heat, grinding burn and cracks are produced because the arcuate length $l_a$ of the workpiece in contact with a grinding wheel decreases as illustrated in FIG. 2 (A). In the prior art cam grinding making use of this characteristic, a workpiece is rotated at a high velocity in the order of 80 rpm over a rough grinding cycle, but the infeed velocity $F_1$ of the grinding wheel higher than about 25 mm/min is not used, because if the infeed velocity exceeds this value, great vibrations and a large uncut portion are introduced. Thus, it is quite difficult to increase the machining efficiency further. The rough and fine grinding cycles in this case are shown in FIGS. 3 and 4, respectively, in which $N_1$ and $N_2$ indicate high and low velocity rotation regions, respectively, $F_2$ is the infeed velocity at finishing that is set to about one-tenth the velocity $F_1$, and $D_1$ and $D_2$ are allowances for rough and finish grindings, respectively. These allowances are so set that the relation $D_1 = 15\ D_2$ holds.

On the other hand, when the workpiece is rotated at a lower velocity, the quantity of change of the grinding removal rate is smaller and the arcuate length $l_b$ of the workpiece in contact with the grinding wheel is longer as illustrated in FIG. 2 (B). Accordingly, the load imposed on each one abrasive grain is lighter and the acceleration that a rocking table experiences is smaller, permitting an increase in the infeed velocity of the grinding wheel. The prior art cam grinding utilizing this characteristic is effected under such conditions that the workpiece is rotated at a low velocity of 30 rpm ($N_3$) when the grinding wheel is pressed against the workpiece and that it is rotated at a high velocity of 60 rpm ($N_4$) during spark out occuring after the cutting. In such a grinding operation, the infeed velocity of the grinding wheel can be made larger than the foregoing value and can be increased to about 40 mm/min ($F_3$), but the slow velocity of the rotation of the workpiece increases the arcuate length $l_b$ in contact with the wheel as shown in FIG. 2 (B), whereby grinding burn and cracks occur more often. For this reason, the grinding velocity is unwillingly made low, sacrificing machining efficiency. The rough and fine grinding cycles are illustrated in FIGS. 5 and 6, respectively, where the infeed velocity $F_4$ at finishing is set to be about one-tenth the velocity $F_3$. The values of the allowances $D_1$ and $D_2$ for rough and fine grindings, respectively, are set so as to be substantially the same as those in FIGS. 3 and 4.

SUMMARY OF THE INVENTION

In view of these difficulties, it is an object of the present invention to provide a method which can machine a workpiece in a shortened time by substantially increasing the infeed velocity of a grinding wheel to enhance productivity while at the same time keeping the surface of the wheel from roughening which would usually be caused by an increase in the infeed velocity, preventing incomplete grinding, suppressing the generation of profile error and preventing grinding burn from remaining in the finished surface.

It is another object of the invention to provide a method which increases the infeed velocity of a grinding wheel to enhance the machining efficiency while making the rotating velocity of a workpiece low to avoid the generation of vibration and increase of uncut portion.

In accordance with the teachings of the invention, a grinding wheel is entered into a workpiece in three steps to control the quantity of heat generated for preventing the generation of grinding burn, so that burnt layer does not remain on the finished surface.

More specifically, the method according to the invention comprises the steps of roughly grinding a workpiece, then dressing a grinding wheel and subjecting the workpiece to a finish grinding. At least one of the two grinding steps comprises three grinding sub-steps, each of which comprises the steps of effecting an infeed of a grinding wheel and then removing the uncut portion. In each infeed step, the wheel is driven such that it enters the workpiece to a given depth during a short time. Even in the first sub-step of the finish grinding, this time is so determined that it is taken by the workpiece to rotate once or twice, for example. In the removing sub-step subsequent to the infeed sub-step, the infeed of the wheel is stopped and so rotation of the workpiece grinds itself. In this way, in the present method, in each grinding sub-steps, the infeed of the wheel is effected rapidly, and thereafter rotation of the workpiece removes an amount of metal corresponding to the depth of the entered wheel from the workpiece.

Other objects and features of the present invention will appear in the course of the description thereof which follows.

DETAILED DESCRIPTION OF THE INVENTION

Figure 7:
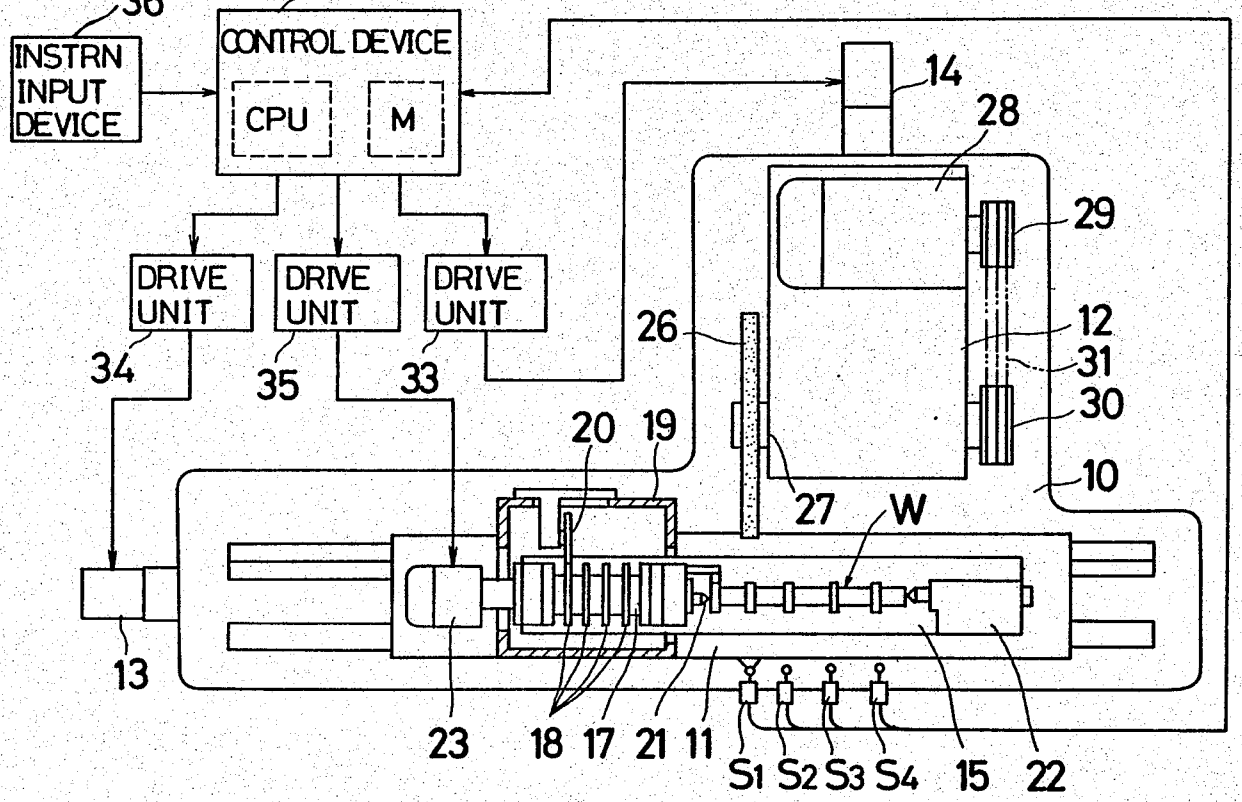
FIGS. 7 and 8 show the construction of a cam grinder by which a method according to the present invention is practiced.
Figure 8:
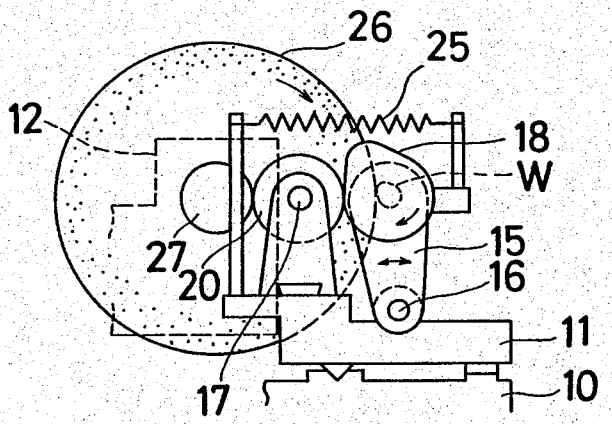

Referring next to FIGS. 7 and 8, there is shown the construction of a grinding machine for practicing a method according to the present invention. The body of the machine consists of a bed 10, on which a work table 11 and a wheel head 12 are guided so that they can slide in directions perpendicular to each other. The movements of the table 11 and the head 12 are controlled by servomotors 13 and 14, respectively. A rocking table 15 is pivoted to the table 11 so that it can rock about a pivot member 16 on the table 11. A work spindle 17 extending parallel to the axis about which the rocking table 15 rocks is journaled in one end of the table 15. A plurality of master cams 18 are securely fixed to the central portion of the spindle 17. A follower roller 20 is rotatably supported to a headstock 19 firmly secured to the table 11. The tension of a spring 25 brings one of the master cams and the roller 20 in abutting engagement with each other to impart a rocking motion to the rocking table 15. A center 21 is held to one end of the work spindle 17, and a foot stock 22 is disposed at the other end of the table 15 in opposition to the center 21, whereby a cam shaft, or a workpiece W, coaxial with the cam 18 is supported. A variable speed motor 23 is connected to the spindle 17 on the rocking table 15 to rotate it. A grinding wheel 26 is mounted on a wheel shaft 27, which is rotatably held to the wheel head 12. Disposed on the head 12 is a servomotor 28 whose rotary motion is imparted to the shaft 27 via pulleys 29, 30 and a belt 31.

The operation of each component of the aforementioned cam grinder is controlled by a control device 32 in accordance with preprogrammed instruction data. The servomotors 14, 13 and 23 for driving the wheel head, the table 11 and the work spindle, respectively, are connected with the control device 32 via servomotor drive units 33, 34 and 35, respectively. Thus, three-stage infeeds of the wheel head 12 (described later), changeover of the rotating speed of the workpiece driven by the motor 23 from a low value to a high value and vice versa and table indexing for causing a cam subjected to grinding and the grinding wheel to correspond to each other are controlled in accordance with the control instructions issuing from the control device 32. Indicated by $S_1$, $S_2$, etc., are limit switches for confirmation of the positions associated with table indexing. The signals derived from the switches for the confirmation are fed to the control device 32 to stop the motor 13.

The control device 32 includes an instruction input device 36 for receiving control instructions which are issued to achieve a grinding cycle (described later) according to the invention. Grinding conditions including the infeed velocity of the wheel head, the depth of cut, the rotating velocity of the workpiece, the quantity of table indexing are applied to the device 36 in succession and stored in a memory M.

Figure 9:
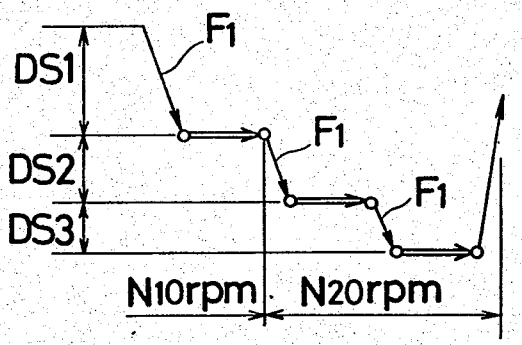
FIG. 9 illustrates a rough grinding cycle used in a method according to the invention.
Figure 10:
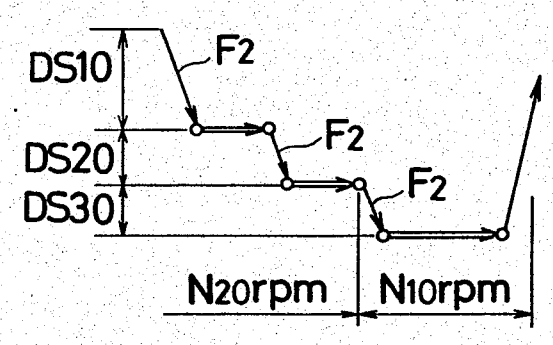
FIG. 10 illustrates a finish grinding cycle used in a method according to the invention.

Grinding cycles characterizing the invention are next described in connection with FIGS. 9 and 10. FIG. 9 illustrates a rough grinding cycle and FIG. 10 illustrates a finish or fine grinding cycle. In either cycle, the infeed of a grinding wheel is effected in three steps. During the first step infeed of the rough grinding cycle and upon spark-out grinding at the ending of the infeed, a workpiece is rotated at a low velocity of 40 rpm ($N_{10}$). In the example of FIG. 9, it is rotated at the low velocity until the end of the first rough step is reached, but it is also possible to continue the slow rotation until a halfway point of the spark-out grinding subsequent to the ending of the second step infeed. During the third step infeed, the workpiece is rotated at a high velocity of 75 rpm ($N_{20}$), and after spark-out grinding the wheel head is rapidly restored to its original state.

Figures 2A, 2B:
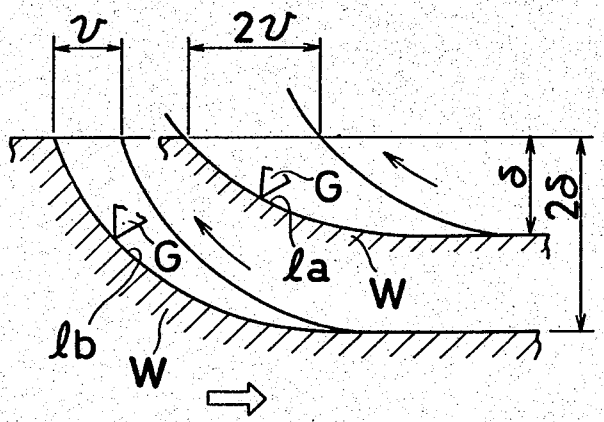
FIGS. 2(A) and 2(B) illustrate the manner in which a workpiece is ground when its rotating velocity is varied.
Figure 1:
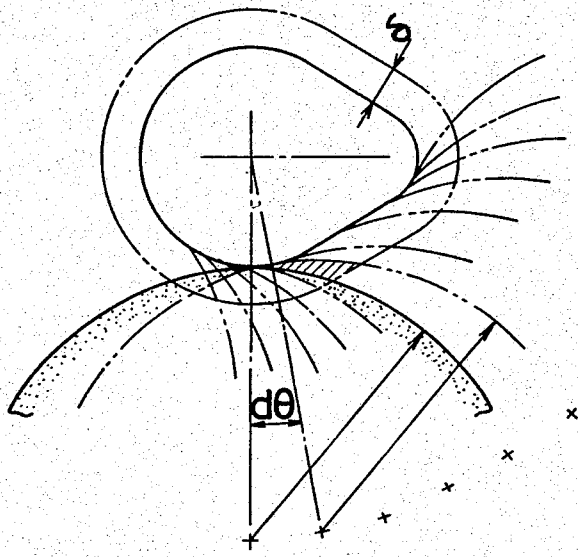
FIG. 1 illustrates the change in the rate of removed material by grinding.
Figure 3:
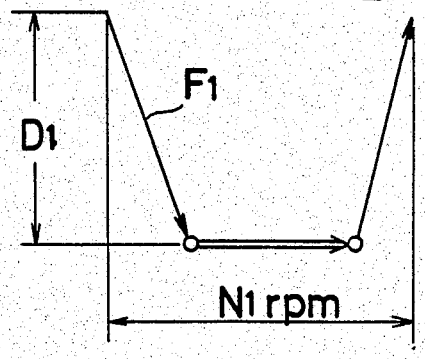
FIG. 3 shows a prior art rough grinding cycle.
Figure 4:
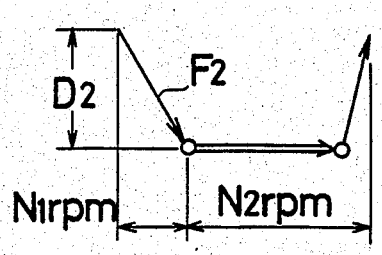
FIG. 4 shows a prior art finish grinding cycle.
Figure 5:
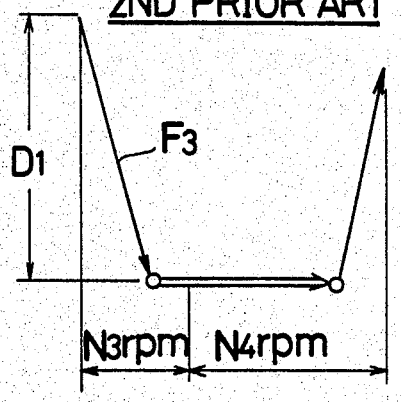
FIG. 5 shows another prior art rough grinding cycle.
Figure 6:
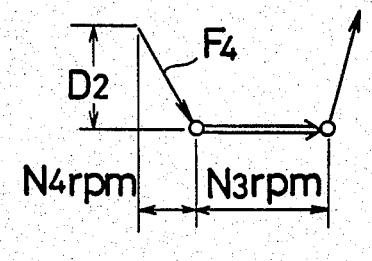
FIG. 6 shows yet another prior art finish grinding cycle.

The infeed velocity $F_1$ of the grinding wheel is about 60 mm/min which is about 2.5 times that of FIG. 3 and about 1.5 times that of FIG. 5. Since the rotating velocity of the workpiece is low, grinding burn is difficult to avoid for the foregoing reasons, but the quantity of heat generated is managed in the following manner so that layer burnt by the grinding and burn cracks do not remain on the machined surface.

For a constant infeed velocity, the quantity of heat burning the workpiece is in proportion to the depth of the infeed and the depth of burnt and cracked layers is also in proportion to the depth of the infeed. Consequently, the depth of cut in the first step $DS_1$ is so set that the burnt and cracked layers produced may not be greater than the depth that can be removed by the next step of infeed. The depths of cut in the second and third steps $DS_2$ and $DS_3$, respectively, are set in the same way. Therefore, the depth $DS_2$ must be smaller than the depth $DS_1$, and the depth $DS_3$ must be smaller than the depth $DS_2$. A practical ratio of these depths determined experimentally is approximately as follows:

$$DS_1:DS_2:DS_3 = 150:10:1$$

$DS_1$ is set to approximately 3 mm. The grinding burn problem can be solved by controlling the depths of infeed in these steps in this fashion.

For the infeed velocity of $F_1$, the time required for the first step infeed is 2 or 3 seconds, the depth of the infeed being greatest. The end of the infeed is reached while the workpiece rotates once or twice. The times required for the second and third step infeeds are about 0.2 second and 0.02 second, respectively, and so these feed ends are immediately reached before the workpiece rotates once. Therefore, the workpiece is ground under a constant load. The time taken by the workpiece to rotate 1.5 times will suffice for the spark-out grinding occuring at the ending of each step of infeed, because the rotating velocity of the workpiece is low and there is a little portion left uncut and still because it is ground under a constant load condition.

In the fine grinding cycle shown in FIG. 10, the rotating velocity of the workpiece during the third fine grinding step is made low as indicated by $N_{10}$ to secure a certain degree of surface roughness, and while the first and second fine grinding steps are performed, it is rotated at a high velocity of $N_{20}$. Thus, the fine cycle is comprised of three sub-steps. The depth of infeed in this case is less than one-hundredth that in the first sub-step of the rough grinding cycle, and therefore even if the rotating velocity of the workpiece is high, the rate of the removed material itself is small, thus the quantity of change will introduce no problem. Hence, it is possible to increase the velocity of wheel infeed to 30 mm/min, that is, one-half of $F_1$, without being affected by vibration and other phenomena.

In this way, the infeed operation comprising the sub-steps permits substantial increase in the infeed velocities in the rough and fine grinding cycles and allows one to reduce the quantity of material left uncut, whereby the time required for the spark-out grinding can be shortened. The cycle time can be also shortened to a great extent, increasing the machining efficiency quite greatly. Thus, the net machining time can be decreased by 30–50% as compared with the time in the aforementioned prior art technique. Further, decrease in the machining accuracy can be circumvented.

As described hereinbefore, in accordance with the cam grinding method of the invention, the workpiece is rotated at a low velocity and the infeed of the grinding wheel is effected rapidly, the infeed operation consisting of three sub-steps. Therefore, higher infeed than the conventional cam grinding cycle can be attained. Further, as the quantity of change of the removed material by grinding can also be reduced, thus permitting a decrease in the quantity of the portion left uncut. The result is that the cycle time can be shortened and the machining efficiency is increased vastly. Grinding burn and cracks which would conventionally be caused by a slow velocity of the workpiece rotation are prevented by controlling the quantity of heat generated employing the infeed operation comprising the three sub-steps so as not to allow affected layer to be left deeper than an allowance which can be removed in the next step of infeed. In other words, the solution to the problems of grinding burn and cracks as stated above allows high speed infeed.

It is to be noted that the rotational speed of the workpiece in the rough grinding cycle may be changed at the end of infeed movement in the second rough grinding step or the end of the second rough grinding step and that the rotational speed of the workpiece in the fine grinding cycle may be changed at the end of the first fine grinding step, the end of infeed movement in the second fine grinding step or the end of infeed movement in the third fine grinding step.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding a workpiece by imparting to the workpiece of rotary motion and a rocking motion which conforms to the profile of a master cam, and moving a rotating grinding wheel and the workpiece relative to each other such that the wheel is pressed against the workpiece so that its shape corresponds to the profile of the master cam, the method comprising:

a first rough grinding step in which the grinding wheel and the workpiece are moved relative to each other such that the wheel is rapidly entered into the workpiece to a first depth of infeed ($DS_1$) while the workpiece is rotated at a low velocity, a second rough grinding step in which the wheel and the workpiece are moved relative to each other such that the wheel is rapidly entered into the workpiece to a second depth of infeed ($DS_2$) less than the first depth ($DS_1$) while the workpiece is rotated at a second velocity not less than said low velocity, and a third rough grinding step in which the workpiece and the wheel are moved relative to each other such that the wheel is rapidly entered into the workpiece to a third depth of infeed ($DS_3$) less than the second depth ($DS_2$) while the workpiece is rotated at a high velocity considerably greater than said low velocity, each of the first, second and third grinding steps being followed directly by a step of rotating the workpiece at least once for removing any uncut portion in a state that the relative infeed motion between the workpiece and the wheel is ceased after the wheel has reached the end of the relative infeed.

2. A method of grinding a workpiece for shaping it into a cam as set forth in claim 1, further including a fine grinding step following said third rotating step, in which the grinding wheel and the workpiece are moved relative to each other such that the workpiece is finely ground.

3. A method of grinding a workpiece for shaping it into a cam as set forth in claim 2, wherein the rotating velocity of the workpiece in the second rough grinding step is the same as that in the third rough grinding step.

4. A method of grinding a workpiece for shaping it into a cam as set forth in claim 3, wherein the rotating velocity of the workpiece in each of the second and third grinding steps is at least 1.5 times the velocity in the first grinding step.

5. A method of grinding a workpiece for shaping it into a cam as set forth in claim 2, wherein the relative velocity at which the grinding wheel is entered into the workpiece in each of the first, second and third grinding steps is the same.

6. A method of grinding a workpiece for shaping it into a cam as set forth in claim 5, wherein the grinding wheel is entered into the workpiece to the first depth of infeed ($DS_1$) before the workpiece completes two 360 degree rotations in the first rough grinding step, and wherein the grinding wheel is entered to the second and third depths of infeed ($DS_2$) and ($DS_3$), respectively, before the workpiece completes one 360 degree rotation in the second and third grinding steps, respectively.

7. A method of grinding a workpiece as set forth in claim 2, wherein said fine grinding step comprises:

a first fine grinding sub-step in which the workpiece and the grinding wheel are moved relative to each other such that the wheel is rapidly entered into the workpiece to a fourth depth of infeed ($DS_{10}$) while the workpiece is rotated at a high velocity, a second fine grinding sub-step in which the workpiece and the grinding wheel are moved relative to each other such that the wheel is rapidly entered into the workpiece to a fifth depth of infeed ($DS_{20}$) less than the fourth depth ($DS_{10}$) while the workpiece is rotated at the same high velocity as in the first sub-step, and a third grinding sub-step in which the workpiece and the grinding wheel are moved relative to each other such that the wheel is rapidly entered into the workpiece to a sixth depth of infeed ($DS_{30}$) less than the fifth depth ($DS_{20}$) while the workpiece is rotated at a low velocity, each of the first, second and third grinding sub-steps being followed directly by a respective spark-out grinding sub-step in which the workpiece completes at least one 360 degree rotation under a state that the relative motion between the workpiece and the wheel is ceased after the wheel has reached the end of each infeed.

8. A method of grinding a workpiece as set forth in claim 7, wherein the rotating velocity of the workpiece in each of the first and second fine grinding sub-steps is equal to that in the third rough grinding step, and wherein the rotating velocity of the workpiece in the third fine grinding sub-step is equal to that in the first rough grinding step.

9. A method of grinding a workpiece as set forth in claim 7, wherein the sum of the fourth, fifth and sixth depths of infeed ($DS_{10}$), ($DS_{20}$) and ($DS_{30}$), respectively, is less than one-hundredth the first depth of infeed ($DS_1$).

10. A method of grinding a workpiece by imparting a rotary motion and a rocking motion, which conforms to the profile of a master cam, to the workpiece and moving a rotating grinding wheel and the workpiece relative to each other such that the wheel is pressed against the workpiece so that its shape corresponds to the profile of the master cam, the method comprising:

a rough grinding step in which the wheel and the workpiece are moved relative to each other such that the wheel is entered into a workpiece to grind and remove most of the finishing allowance of the workpiece, and a fine grinding step in which the wheel and the workpiece are moved relative to each other such that the wheel is entered into the workpiece to grind and remove the remaining allowance of the workpiece after the termination of the rough grinding step, the fine grinding step comprising a first fine grinding sub-step in which the workpiece and the grinding wheel are moved relative to each other such that the wheel is rapidly entered into the workpiece to a first depth of infeed ($DS_{10}$) while the workpiece is rotated at a high velocity, a second fine grinding sub-step in which the workpiece and the grinding wheel are moved relative to each other such that the wheel is rapidly entered into the workpiece to a second depth of infeed ($DS_{20}$) less than the first depth ($DS_{10}$) while the workpiece is rotated at the same high velocity as in the first sub-step, and a third grinding sub-step in which the workpiece and the grinding wheel are moved relative to each other such that the wheel is rapidly entered into the workpiece to a third depth of infeed ($DS_{30}$) less than the second depth ($DS_{20}$) while the workpiece is rotated at a low velocity, each of the first, second and third grinding sub-steps being followed by a respective spark-out grinding sub-step in which the workpiece completes at least one 360 degree rotation under a state that the relative infeed motion between the workpiece and the wheel is ceased after the wheel has reached the end of each infeed.

* * * * *